US007360604B2

(12) United States Patent
Lohbeck et al.

(10) Patent No.: US 7,360,604 B2
(45) Date of Patent: Apr. 22, 2008

(54) EXPANDER SYSTEM FOR STEPWISE EXPANSION OF A TUBULAR ELEMENT

(75) Inventors: Wilhelmus Christianus Maria Lohbeck, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 106 days.

(21) Appl. No.: 10/554,071

(22) PCT Filed: Apr. 16, 2004

(86) PCT No.: PCT/EP2004/050549

§ 371 (c)(1),
(2), (4) Date: Oct. 21, 2005

(87) PCT Pub. No.: WO2004/097170

PCT Pub. Date: Nov. 11, 2004

(65) Prior Publication Data

US 2006/0191691 A1 Aug. 31, 2006

(30) Foreign Application Priority Data

Apr. 25, 2003 (EP) ..... 03252655

(51) Int. Cl.
*E21B 23/01* (2006.01)
*E21B 43/10* (2006.01)

(52) U.S. Cl. ..... 166/384; 166/207

(58) Field of Classification Search ..... 166/55, 166/207, 384, 206
See application file for complete search history.

(56) References Cited

U.S. PATENT DOCUMENTS

| | | | | |
|---|---|---|---|---|
| 1,393,620 | A | 10/1921 | Gavin | |
| 3,583,187 | A | 6/1971 | Kontranowski | 72/58 |
| 3,583,200 | A | 6/1971 | Cvijanovic | 72/393 |
| 6,352,112 | B1 * | 3/2002 | Mills | 166/277 |
| 6,450,261 | B1 * | 9/2002 | Baugh | 166/277 |
| 7,128,146 | B2 * | 10/2006 | Baugh et al. | 166/206 |

(Continued)

FOREIGN PATENT DOCUMENTS

EP 0643794 3/1995

(Continued)

OTHER PUBLICATIONS

Intl Search Report dated Jul. 27, 2004 (PCT/EP2004/050549).

(Continued)

*Primary Examiner*—Kenneth Thompson

(57) ABSTRACT

An expander system for radially expanding a tubular element having an unexpanded portion of a first inner diameter, the expander system including an expander movable between a radially retracted mode and a radially expanded mode, the expander being operable to expand the tubular element from the first inner diameter to a second inner diameter larger than the first inner diameter by movement of the expander from the radially retracted mode to the radially expanded mode thereof, wherein the expander has a contact section of a diameter larger than the first inner diameter when the expander is in the radially retracted mode, and wherein the contact section is arranged to prevent axial movement of the expander through the unexpanded portion of the tubular element when the expander is in the radially retracted mode.

19 Claims, 7 Drawing Sheets

U.S. PATENT DOCUMENTS

| | | | | |
|---|---|---|---|---|
| 7,182,141 | B2 * | 2/2007 | Tran et al. | 166/384 |
| 2003/0075339 | A1 | 4/2003 | Gano et al. | 166/380 |
| 2005/0115719 | A1 * | 6/2005 | Abercrombie Simpson et al. | 166/383 |
| 2006/0196679 | A1 * | 9/2006 | Brisco et al. | 166/384 |

FOREIGN PATENT DOCUMENTS

| | | | |
|---|---|---|---|
| SU | 1745873 | * | 7/1992 |
| WO | 93/25799 | | 12/1993 |
| WO | 00/26500 | | 5/2000 |
| WO | 02/052124 | | 7/2002 |
| WO | 02/059456 | | 8/2002 |
| WO | 03/010414 | | 2/2003 |

OTHER PUBLICATIONS

Intl Preliminary Report on Patentability (PCT/EP2004/050549).
European Patent Search Report dated Oct. 15, 2003.

* cited by examiner

EXPANDER SYSTEM FOR STEPWISE EXPANSION OF A TUBULAR ELEMENT

PRIORITY CLAIM

The present application claims priority on European Patent Application 03252655.0 filed Apr. 25, 2003.

FIELD OF THE INVENTION

The present invention relates to an expander system for radially expanding a tubular element from a first inner diameter to a second inner diameter larger than the first inner diameter.

BACKGROUND OF THE INVENTION

Expansion of tubular elements finds increasing use in the industry of hydrocarbon fluid production from an earth formation, whereby boreholes are drilled to provide a conduit for hydrocarbon fluid flowing from a reservoir zone to a production facility to surface. Conventionally such borehole is provided with several tubular casing sections during drilling of the borehole. Since each subsequent casing section must pass through a previously installed casing section, the different casing section are of decreasing diameter in downward direction which leads to the well-know nested arrangement of casing sections. Thus the available diameter for the production of hydrocarbon fluid decreases with depth. This can lead to technical and/or economical drawbacks, especially for deep wells where a relatively large number of separate casing sections is to be installed.

To overcome such drawbacks it has already been practiced to use a casing scheme whereby individual casings are radially expanded after installation in the borehole. Such casing scheme leads to less reduction in available diameter of the lowest casing sections.

Generally the expansion process is performed by pulling, pumping or pushing an expander cone through the tubular element (such as a casing section) after the tubular element has been lowered into the borehole. However the forces required to move the expander cone through the tubular element can be extremely high since such force has to overcome the cumulated expansion forces necessary to plastically deform the tubular element, and the frictional forces between the expander cone and the tubular element.

EP-0643794-A discloses a system for expanding a tubular element using a tool movable between a radially retracted mode and a radially expanded mode. The tubular element is expanded in cycles whereby in each cycle the tool is positioned in a portion of the tubular element whereby the tool is in the retracted mode, and whereby subsequently the tool is expanded thereby expanding said tubular element portion.

SUMMARY OF THE INVENTION

The present inventions include an expander system for radially expanding a tubular element having an unexpanded portion of a first inner diameter, the expander system including an expander movable between a radially retracted mode and a radially expanded mode, the expander being operable to expand the tubular element from said first inner diameter to a second inner diameter larger than the first inner diameter by movement of the expander from the radially retracted mode to the radially expanded mode thereof, wherein the expander comprises a contact section of a diameter larger than said first inner diameter when the expander is in the radially retracted mode, and wherein said contact section is arranged to prevent axial movement of the expander through the unexpanded portion of the tubular element when the expander is in the radially retracted mode.

BRIEF DESCRIPTION OF THE DRAWINGS

The invention will be described further by way of example in more detail, with reference to the accompanying drawings in which.

DETAILED DESCRIPTION OF THE INVENTION

Figure 1A:
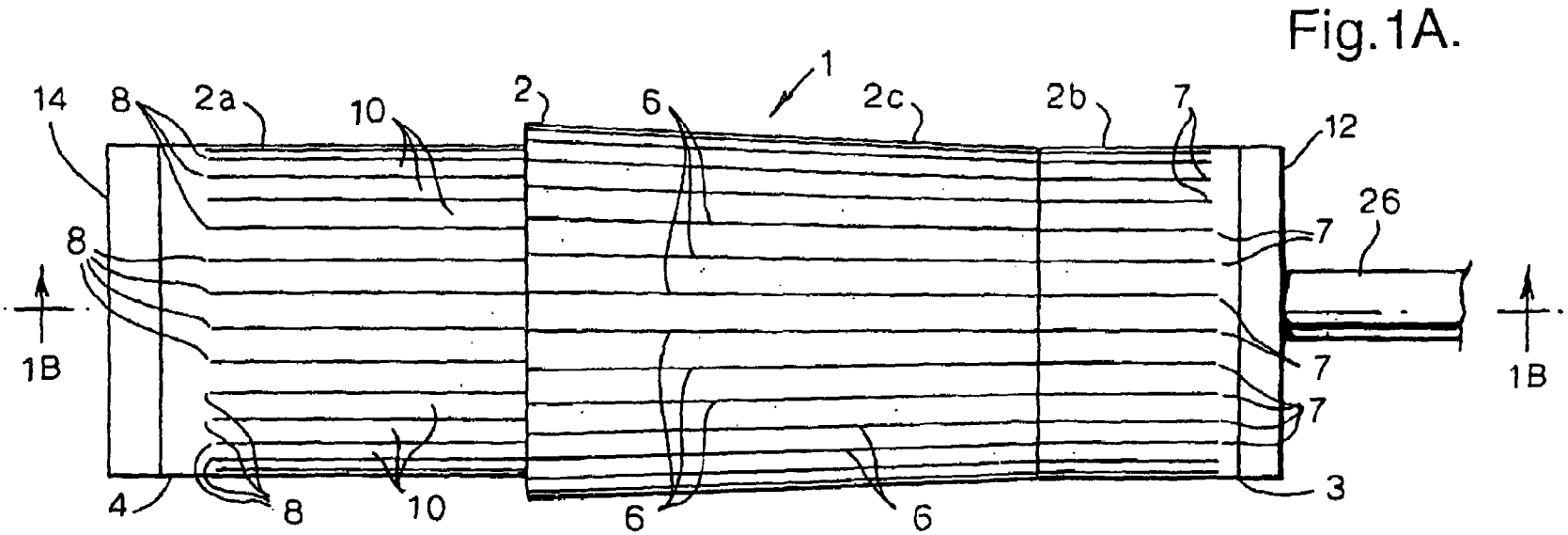
FIG. 1A schematically shows a side view of an embodiment of an expander for use in the system of the invention.

In the Figures like reference numerals relate to like components.

The term "unexpanded portion" of the tubular element is intended to refer to a portion of the tubular element which is to be expanded to a larger diameter. Thus it is to be understood that such "unexpanded portion" can be a portion which has not yet been subjected to expansion before or to a portion which has already been subjected to expansion.

With the expander system of the invention it is achieved that the expander may no longer need to be accurately repositioned after each expansion cycle. By simply exerting an axial force of moderate magnitude to the expander (when in the retracted mode) in the direction in which expansion of the tubular element is progressing, the expander moves forward until the contact section contacts the inner surface of the tubular element. The expander thereby becomes automatically repositioned to perform the next expansion cycle.

Such axial force of moderate magnitude is suitably provided by the weight of the expander, by a pulling string connected to the expander, or by any other suitable means connected to the expander, such as a tractor, a weight element or a drill string. Also drag from a fluid stream passing along the expander, or jet-action from a stream of fluid jetted from the expander during movement to the retracted mode thereof, can provide sufficient force to move the expander forward.

Preferably the expander includes an expansion surface extending in axial direction and being operable to move radially outward so as to expand the tubular element during movement of the expander from the retracted mode to the expanded mode thereof, said expansion surface being of varying diameter in axial direction.

Suitably the contact section has an outer surface coinciding with the expansion surface.

The diameter of the expansion surface preferably increases continuously in axial direction. For example, the expansion surface can be a tapering surface, a frustoconical surface, a convex surface, or a stepwise tapered or convex surface.

To ensure that the tubular element is expanded in a uniform manner it is preferred that the expansion surface is arranged to move radially outward in substantially uniform manner along the length thereof during movement of the expander from the retracted node to the expanded mode thereof.

In a preferred embodiment the expander comprises an expander body including a plurality of body segments spaced along the circumference of the expander body, each segment extending in longitudinal direction of the expander and being movable between a radially retracted position and a radially expanded position.

The expander body is suitable provided with a plurality of longitudinal slots spaced along the circumference of the expander body, each said slot extending between a pair of adjacent body segments. Each body segment is, for example, at both ends thereof integrally formed with the expander body.

The expander body is preferably a tubular expander body, and the actuating means includes an inflatable member arranged within the tubular expander body so as to move each body segment radially outward upon inflation of the inflatable member.

Figure 1B:
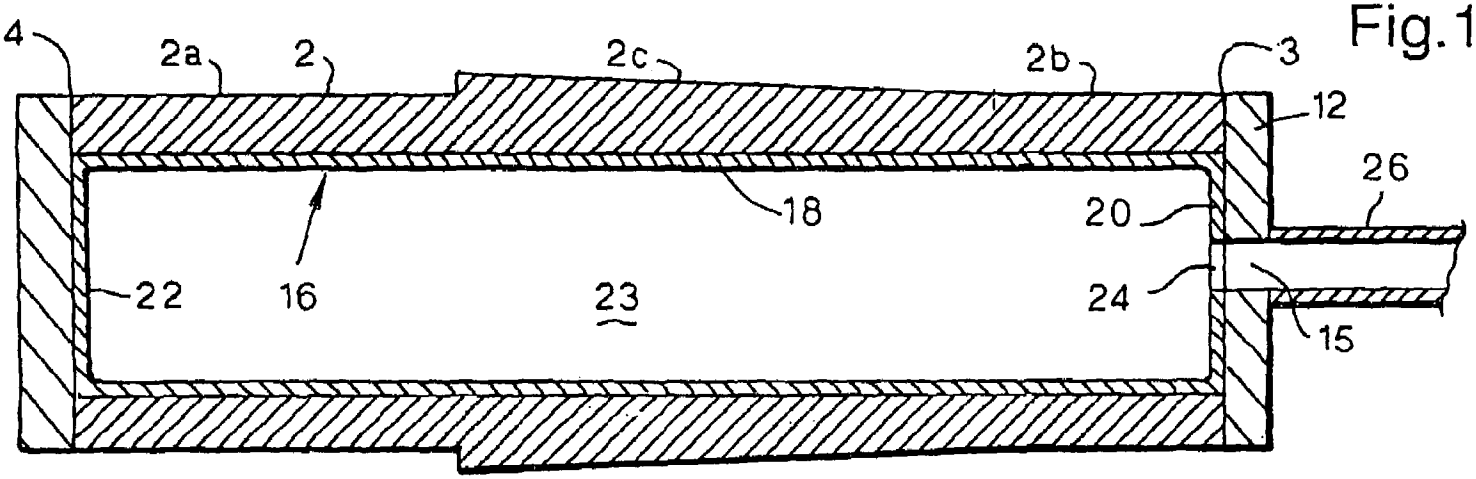
FIG. 1B schematically shows cross-section 1B-1B of FIG. 1A.

Referring to FIGS. 1A and 1B there is shown an expander 1 including a steel tubular expander body 2 having a first end 3 and a second end 4. The expander body 2 includes a cylindrical portion 2*a*, a cylindrical portion 2*b*, and a frustoconical portion 2*c* arranged between the cylindrical portions 2*a* and 2*b*. The frustoconical portion 2*c* tapers in the direction from the first end 3 to the second end 4, from a diameter D1 to a diameter D2 larger than D1. The cylindrical portions 2*a*, 2*b* have a diameter substantially equal to D1. A plurality of narrow longitudinal slots 6 are provided in the expander body 2, which slots are regularly spaced along the circumference of the expander body 2. Each slot 6 extends radially through the entire wall of tubular expander body 2, and has opposite ends 7, 8 located a short distance from the respective ends 3, 4 of the expander body 2. The slots 6 define a plurality of longitudinal body segments 10 spaced along the circumference of the expander body 2, whereby each slot 6 extends between a pair of adjacent body segments 10 (and vice versa). By virtue of their elongate shape and elastic properties, the body segments 10 will elastically deform by radially outward bending upon application of a suitable radial load to the body segments 10. Thus the expander 1 is expandable from a radially retracted mode whereby each body segments 10 is in its rest position, to a radially expanded mode whereby each body segment 10 is in its radially outward bent position upon application of said radial load to the body segment 10.

The expander further includes cylindrical end closures 12, 14 arranged to close the respective ends 3, 4 of the expander body 2, each end closure 12, 14 being fixedly connected to the expander body 2, for example by suitable bolts (not shown). End closure 12 is provided with a through-opening 15.

An inflatable member in the form of elastomeric bladder 16 is arranged within the tubular expander body 2. The bladder 16 has a cylindrical wall 18 resting against the inner surface of the tubular expander body 2, and opposite end walls 20, 22 resting against the respective end closures 12, 14, thereby defining a fluid chamber 23 formed within the bladder 16. The end wall 20 is sealed to the end closure 12 and has a through-opening 24 aligned with, and in fluid communication with, through-opening 15 of end closure 12. A fluid conduit 26 is at one end thereof in fluid communication with the fluid chamber 23 via respective through-openings 15, 24. The fluid conduit 26 is at the other end thereof in fluid communication with a fluid control system (not shown) for controlling inflow of fluid to, and outflow of fluid from, the fluid chamber 23.

Figure 2A:
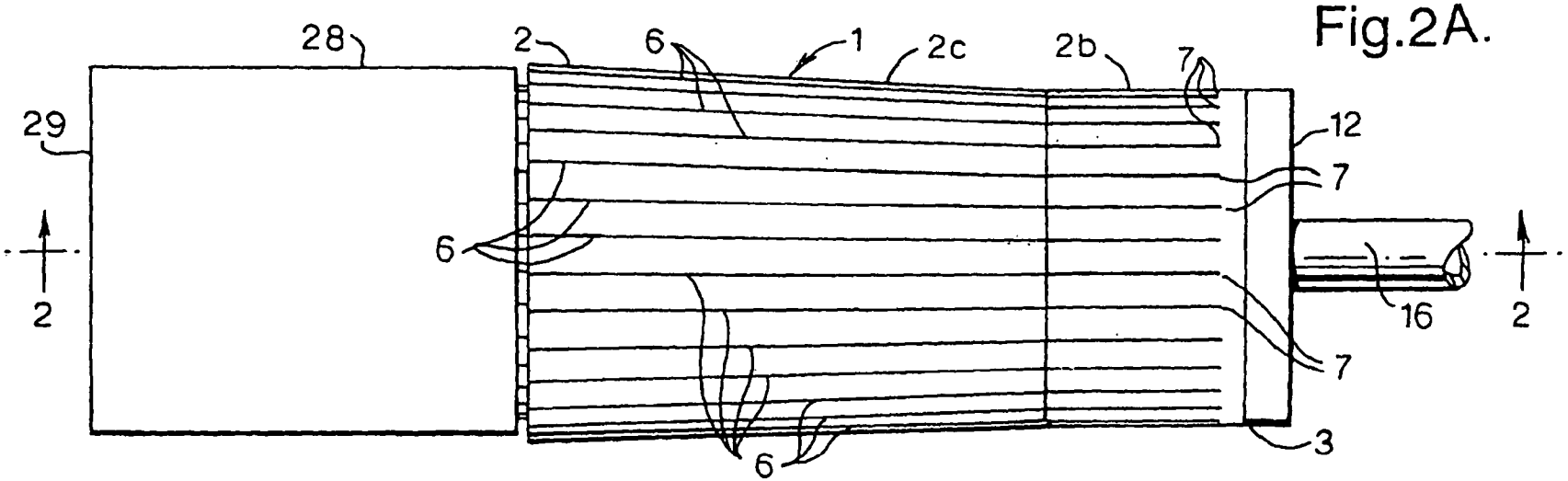
FIG. 2A schematically shows a side view of the expander of FIGS. 1A and 1B with an additional sleeve connected thereto.
Figure 2B:
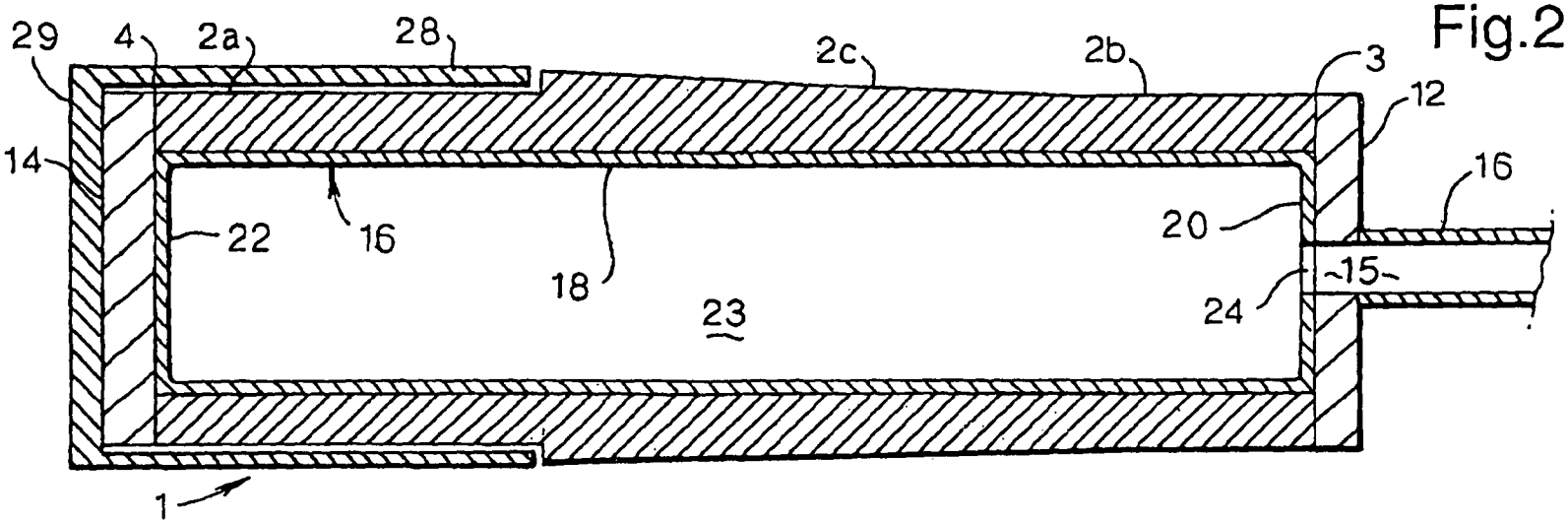
FIG. 2B schematically shows cross-section 2B-2B of FIG. 2A.

In FIGS. 2A and 2B is shown the expander 1 whereby a tubular sleeve 28 is positioned concentrically over the cylindrical portion 2*a* of the expander 1, the sleeve 28 being provided with an end plate 29 bolted to the end closure 14. The sleeve 28 is of inner diameter slightly larger than the outer diameter of cylindrical portion 2*a* of the expander 1.

Figure 4:
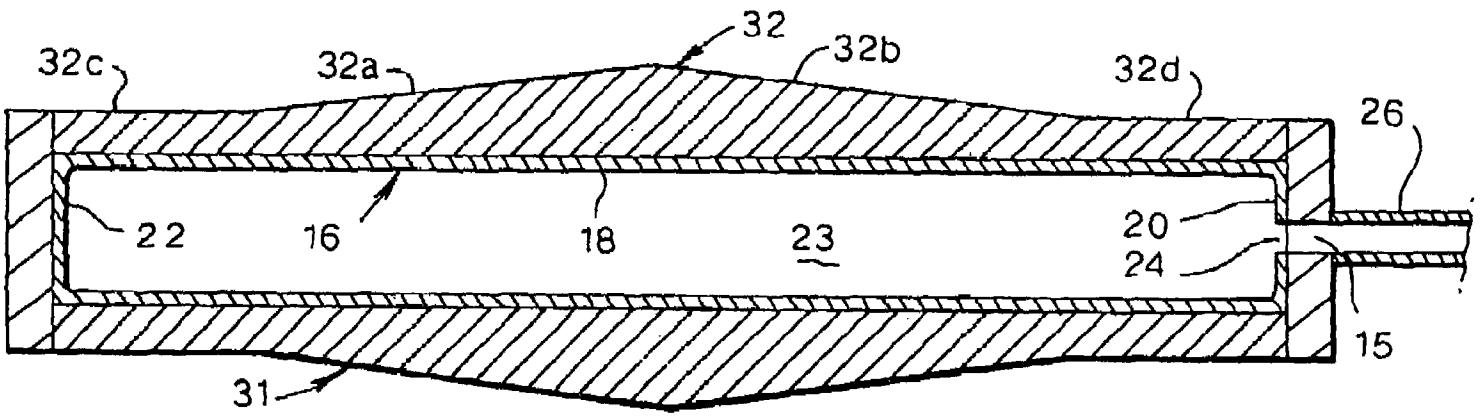
FIG. 4 schematically shows cross-section 4-4 of FIG. 3.
Figure 3:
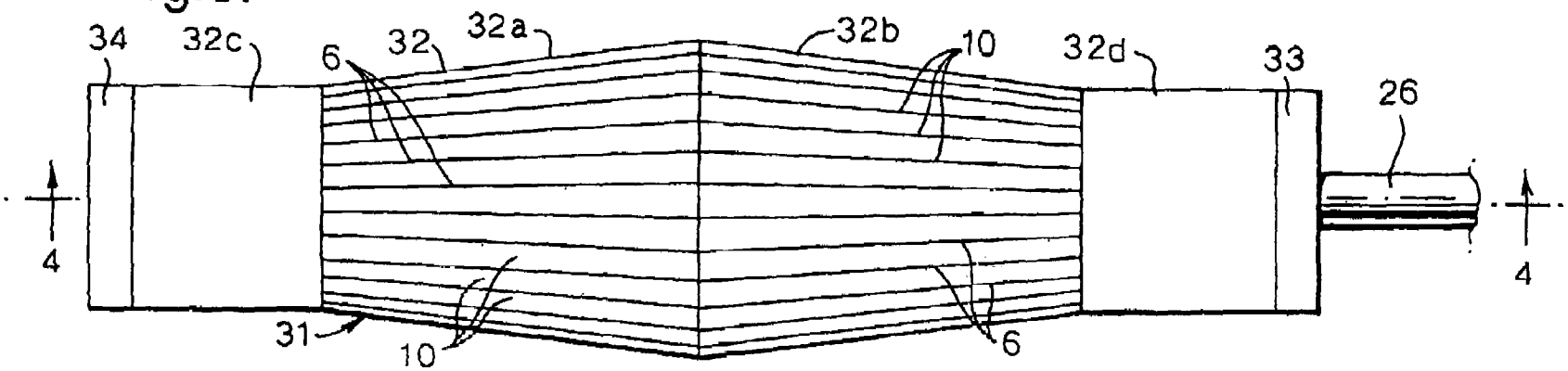
FIG. 3 schematically shows a side view of a first alternative embodiment of an expander for use in the system of the invention.

In FIGS. 3 and 4 is shown a first alternative expander 31 including a steel tubular expander body 32 having a first end 33 and a second end 34. The expander 30 is largely similar to the expander 1 of FIGS. 1 and 2 except that the expander body 32 includes two frustoconical portions 32*a*, 32*b* arranged between respective cylindrical portion 32*c*, 32*d*. The frustoconical portions taper in the direction from the respective ends 33, 34 towards the middle of the expander 31, from diameter D1 to diameter D2 larger than D1. The cylindrical portions 32*c*, 32*d* are of diameter substantially equal to D1.

Figure 5:
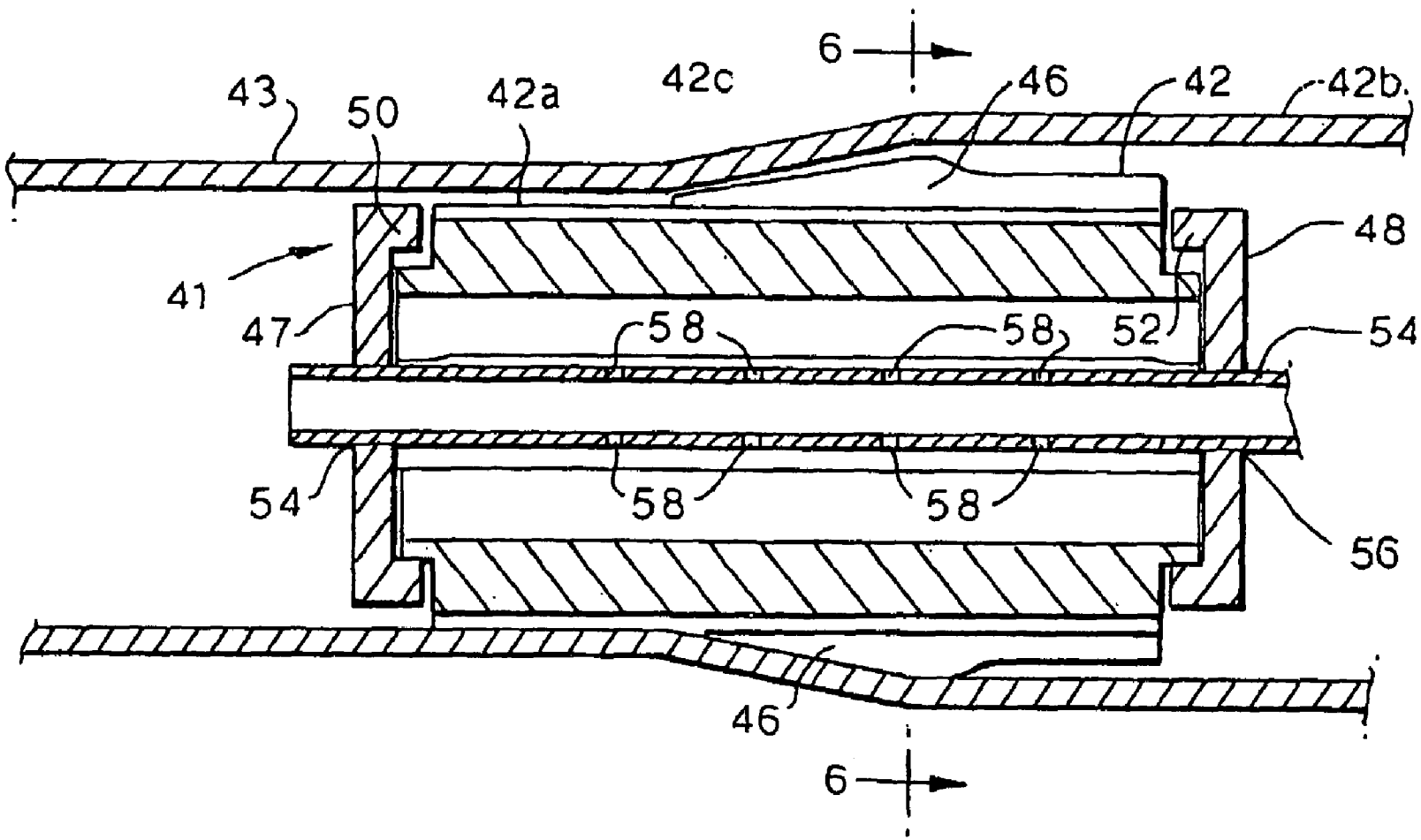
FIG. 5 schematically shows a longitudinal section of a second alternative embodiment of an expander for use in the system of the invention.

In FIG. 5 is shown a second alternative expander 41 including a tubular expander body 42 arranged in a partially expanded tubular element 43. The expander body 42 includes a plurality of separate elongate steel segments 46 regularly spaced along the circumference of the expander body 42. The expander body 42 includes a cylindrical portion 42*a*, a cylindrical portion 42*b*, and a frustoconical portion 42*c* arranged between the respective portions 42*a* and 42*b*. The frustoconical portion tapers from diameter D1 to diameter D2 larger than D1. End plates 47, 48 provided with respective annular stop shoulders 50, 52 are arranged at opposite ends of the expander body 42 to hold the segments 46 in place. The segments 46 are capable of being moved between a radially inward position (as shown in the upper half of FIG. 5) and a radially outward position (as shown in the lower half of FIG. 5) whereby the maximum radially outward position of the segments 46 is determined by the annular stop shoulders 50, 52. Thus the expander 41 assumes a radially retracted mode when the segments 46 are in their respective radially inward positions, and a radially expanded mode when the segments 46 are in their respective radially outward positions.

The end plates 47, 48 have respective central openings 54, 56 through which a fluid conduit 54 extends, the end plates 47, 48 being fixedly connected to the conduit 54. A plurality of openings 58 are provided in the wall of fluid conduit 54 located between the end plates 47, 48.

Figure 6B:
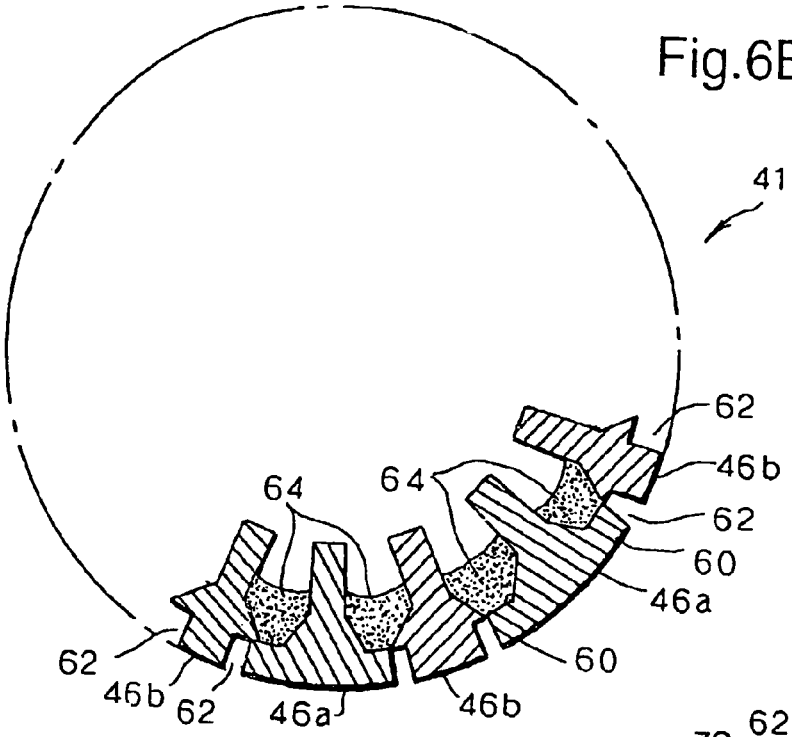
FIG. 6B schematically shows cross-section 6-6 of FIG. 5 when the expander is in expanded mode.
Figure 6C:
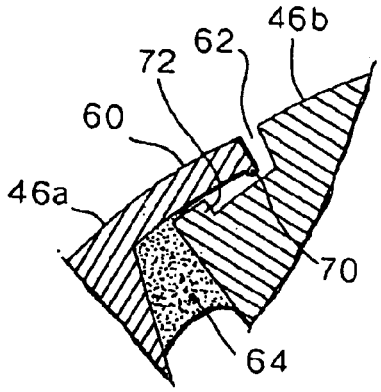
FIG. 6C schematically shows detail A of FIG. 6A.
Figure 6A:
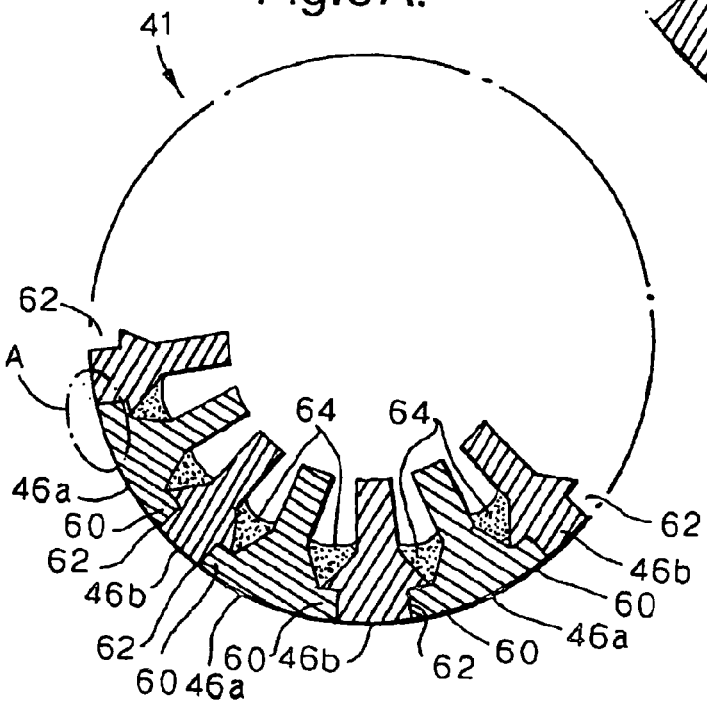
FIG. 6A schematically shows cross-section 6-6 of FIG. 5 when the expander is in retracted mode.

Referring further to FIGS. 6A, 6B is shown the expander 41 when in unexpanded mode (FIG. 6A) and when in expanded mode (FIG. 6B). The series of segments 46 includes segments 46*a* and segments 46*b* alternatingly arranged in circumferential direction of the expander body 42. Each segment 46*a* is at the outer circumference thereof provided with a pair of oppositely arranged lips 60, and each segment 46*b* is at the outer circumference thereof provided with a pair of oppositely arranged recesses 62, whereby each lip 60 of a segment 46*a* extends into a corresponding recess 62 of an adjacent segment 46*b*. For the sake of clarity not all segments 46*a*, 46*b* are shown in FIGS. 6A, 6B. The segments of each pair of adjacent segments 46*a*, 46*b* are interconnected by an elongate elastomer body 64 vulcanised to the segments 46*a*, 46*b* of the pair. The elastomer bodies 64 bias the segments 46 to their respective radially inward positions and seal the spaces formed between the segments 46.

Furthermore the segments 46 are sealed to the end plates 47, 48 by elastomer vulcanised to the segments 46 and to the end plates 47, 48 so that a sealed fluid chamber 66 is formed in the space enclosed by the segments 46 and the end plates 47, 48.

In FIG. 6C is shown detail A of FIG. 6A, whereby it is indicated that each lip 60 is provided with a shoulder 70 and the corresponding recess 62 into which the lip 60 extends is provided with a shoulder 72, the shoulders 70, 72 being arranged to cooperate to prevent the lip 60 from moving out of the corresponding recess 62 when the expander 41 is radially expanded.

Normal use of the expander 1 (shown in FIGS. 1A, 1B) is explained hereinafter with reference to FIGS. 7A-7D showing various stages of an expansion cycle during expanding a steel tubular element 40 extending into a wellbore (not shown) formed in an earth formation whereby the expander is positioned in the tubular element 40 and the conduit 26 extends through the tubular element 40 to the fluid control system located at surface. The largest outer diameter D2 of the expander 1 when in unexpanded mode is larger than the inner diameter d1 of the tubular element 40 before expansion thereof.

In a first stage (FIG. 7A) of the expansion cycle the expander 1 is positioned in the tubular element 40 whereby the expander 1 is in the radially retracted mode thereof. The tubular element 40 has an expanded portion 40*a* with inner diameter d2 at the large diameter side of the expander 1, an unexpanded portion 40*b* with inner diameter d1 at the small diameter side of the expander 1, and a transition zone 40*c* tapering from the unexpanded portion 40*b* to the expanded portion 40*a*. Part of the frustoconical portion 2*c* of the expander 1 is in contact with the inner surface of the tapering transition zone 40*c* of the tubular element 40.

In a second stage (FIG. 7B) of the expansion cycle the fluid control system is operated to pump pressurised fluid, for example drilling fluid, via the conduit 26 into the fluid chamber 23 of the bladder 16. As a result the bladder 16 is inflated and thereby exerts a radially outward pressure against the body segments 10 which thereby become elastically deformed by radially outward bending. The volume of fluid pumped into the bladder 16 is selected such that any deformation of the body segments 10 remains below the elastic limit. Thus the body segments 10 revert to their initial positions after release of the fluid pressure in the bladder 16. The amount of radially outward bending of the body segments 10 is small relative to the difference between d2 and d1. Thus the expander 1 is expanded upon pumping of the selected fluid volume into the bladder 16, from the radially retracted mode to the radially expanded mode thereof. Consequently the tapering transition zone 40*c* and a short section of the unexpanded portion of the tubular element 40 become radially expanded by the expander 1, whereby the amount of expansion corresponds to the amount of radially outward bending of the body segments 10. Such radial expansion of the tubular element 40 is in the plastic domain since the tubular element 40 will be subjected to hoop stresses beyond the elastic limit of the steel of the tubular element 40.

In a third stage (FIG. 7C) of the expansion cycle the fluid control system is operated to release the fluid pressure in the bladder 16 by allowing outflow of fluid from the fluid chamber 23 back to the control system. The bladder 16 thereby deflates and the body segments 10 move back to their initial undeformed shape so that the expander 1 moves back to the radially unexpanded mode thereof. As a result a small annular space will occur between the frustoconical portion 2*c* of the expander body 2, and the inner surface of the expanded transition zone 40*c* of the tubular element 40.

In a fourth stage (FIG. 7D) of the expansion cycle the expander 1 is moved forward (i.e. in the direction of arrow 80) until the frustoconical portion 2*c* of the expander 1 is again in contact with the inner surface of the tapering transition zone 40*c* of the tubular element 40 whereby the annular space vanishes. The body segments 10, if not yet fully back to their initial undeformed shape, further move back to their initial undeformed shape due to being pulled or pushed against the inner surface of the tubular element 40. Forward movement of the expander 1 is achieved by applying a moderate pulling- or pushing force to the fluid conduit 26 at surface.

Figure 7A:
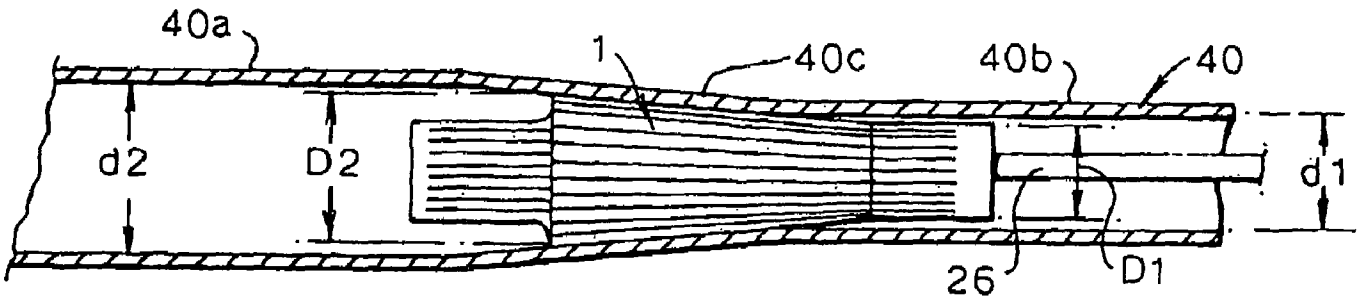
FIGS. 7A-E schematically show various steps during normal use of the expander of FIG. 1.
Figure 7B:
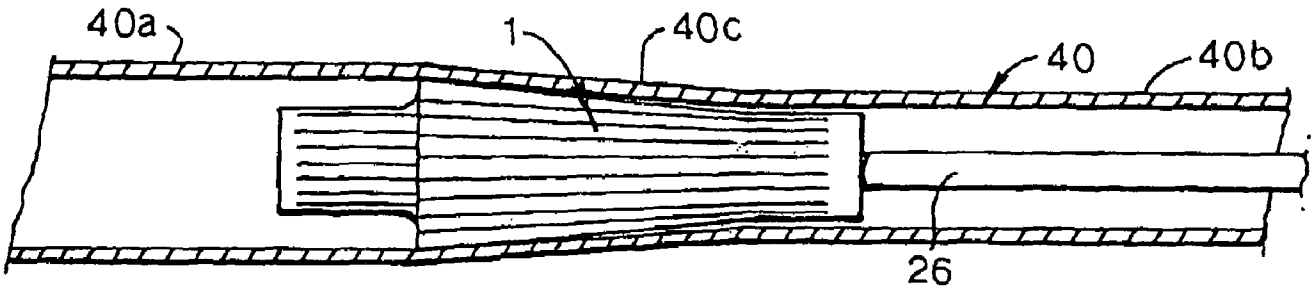
Figure 7C:
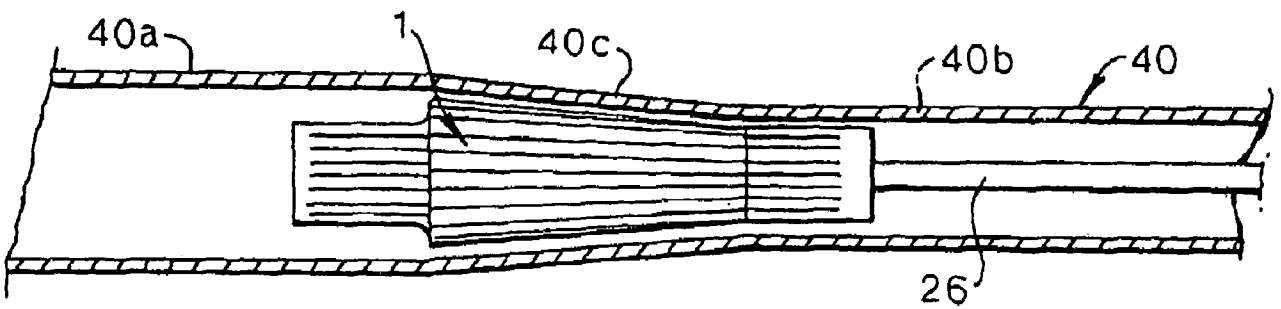
Figure 7D:
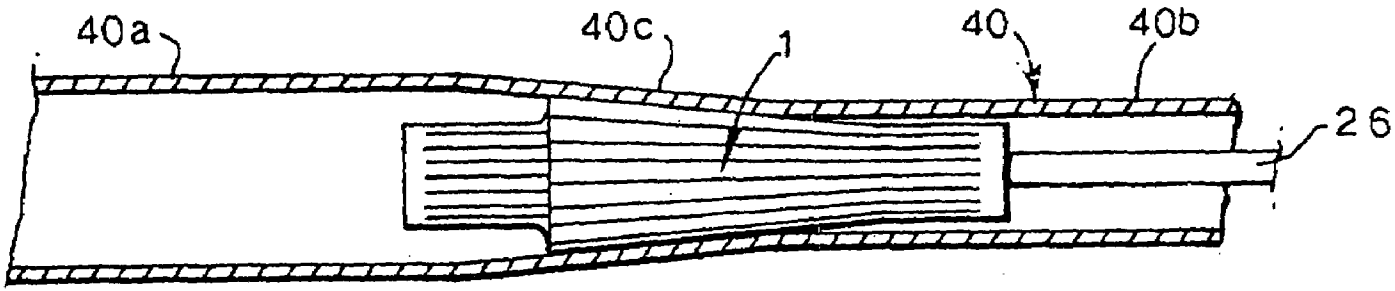
Figure 7E:
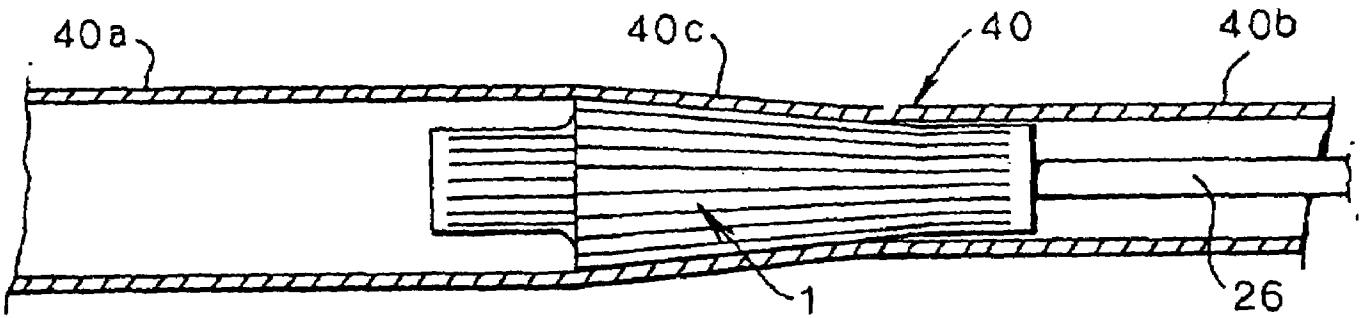

Next the second stage is repeated (FIG. 7E) followed by repetition of the third and four stages. The cycle of second stage, third stage and fourth stage is then repeated as many times as required to expand the entire tubular element 40 or, if desired a portion thereof.

Normal use of the first alternative expander 31 (shown in FIGS. 3, 4) is similar to normal use of the expander 1 described above. An additional advantage of the first alternative expander 31 is that radially outward deformation of each body segment 10 upon movement of the expander 31 from the radially retracted mode to the radially expanded mode occurs more uniformly along the length of the body segment 10.

Normal use of the second alternative expander 41 (shown in FIGS. 5, 6A, 6B) is substantially similar to normal use of the expander 1 described above, except that in the second stage of each expansion cycle pressurised fluid is pumped from the fluid control system via the conduit 54 and the openings 58 into the sealed fluid chamber 66 rather than into the bladder 16 of the embodiment of FIGS. 1, 2. Upon pressurising the fluid chamber 66 the elongate steel segments 46 are biased radially outward until stopped by the stop shoulders 50, 52. Thus the radial outermost position of the segments 46 is determined by the annular stop shoulders 50, 52 thereby ensuring uniform radial expansion of the tubular element 40 in circumferential direction. Radially outward movement of the segments 46 implies an increase of the spacing between the segments 46, which in turn implies stretching in circumferential direction of the elastomer bodies 64 interconnecting the segments 46. Furthermore, during outward movement of the segments 46, the lip 60 of each segment 46*a* moves gradually out of the corresponding recess 62 of the adjacent segment 46*b* so that the fluid pressure in the fluid chamber 66 is transferred via the elastomer bodies to the portions of lips 60 which have moved out of the corresponding recesses 62. It is thereby achieved that the fluid pressure P in the fluid chamber 66 acts on a fictitious inner surface of fluid chamber 66 of diameter corresponding to the inner diameter of the lips 60. Since the available expansion force at the outer surface of the expander body 42 increases with increasing diameter of such fictitious inner surface, the inner diameters of the lips 60 suitably are selected as large as possible.

Normal use of the expander 1 provided with the tubular sleeve 28 (shown in FIGS. 2A, 2B) is substantially similar to normal use of the expander 1 without the tubular sleeve 28. The function of the sleeve 28 is to limit expansion of the cylindrical portion 2*a* of the expander 1 during the expansion of the tubular element 40, particularly at start-up of the expansion process when the cylindrical portion 2*a* still protrudes outside the tubular element 40. Since the inner diameter of the sleeve 28 is somewhat larger than the outer diameter of the cylindrical portion 2*a*, the portions of the segments 10 within the sleeve 28 are allowed to deform radially outward upon pressurising the bladder 16 until the sleeve 28 prevents such further radially outward deformation. It is thus achieved that excessive radially outward deformation of the segments 10 at the location of the cylindrical portion 2*a* is prevented.

Instead of applying an expander body provided with parallel longitudinal slots extending substantially the whole length of the expander body, an expander body can be applied provided with relatively short parallel longitudinal slots arranged in a staggered pattern, for example a pattern similar to the pattern of slots of the tubular element disclosed in EP 0643795 B1 (as shown in FIGS. 1 and 3 thereof). Such staggered pattern has the advantage that widening of the slots during expansion of the expander is better controlled.

In the four stages of each expansion cycle described above fluid is induced to flow into the fluid chamber via the fluid conduit, and out from the fluid chamber via the fluid conduit, in alternating manner. Alternatively the expander can be provided with a controllable valve (not shown) for outflow of fluid from the expander to the exterior thereof.

Suitably the controllable valve is provided with electric control means, the valve being for example a servo-valve. Preferably the electric control means comprises an electric conductor extending through the fluid conduit for the transfer of fluid from the control system to the inflatable member.

Normal use of such expander provided with a controllable valve is substantially similar to normal operation of the expander described above. However a difference is that in the third stage (FIG. 7C) of the expansion cycle, the valve is controlled to allow outflow of fluid from the fluid chamber via the valve to the exterior of the expander. That is to say the fluid flows into tubular element rather than back through the fluid conduit. Pumping of fluid from the control system via the fluid conduit into the fluid chamber can be done in a continuous or discontinuous way, while outflow of fluid from the fluid chamber is controlled by means of the valve.

In the above described embodiments, the expander is alternatingly expanded and retracted by inducing fluid to flow into the fluid chamber, and inducing fluid to flow out from the fluid chamber in alternating mode. In an alternative system the expander is alternatingly expanded and retracted by alternatingly moving a body into the fluid chamber and out from the fluid chamber. Such body can be, for example, a plunger having a portion extending into the fluid chamber and a portion extending outside the fluid chamber. The plunger can be driven by any suitable drive means, such as hydraulic, electric or mechanical drive means.

Preferably the half top-angle of the frustoconical section of the expander is between 3 and 10 degrees, more preferably between 4 and 8 degrees. In the example described above the half top-angle is about 6 degrees.

Suitably the expander is a collapsible expander which can be brought into a collapsed state whereby the expander can be moved through the unexpanded portion of the tubular element.

The third and fourth stages of the expansion cycle described above can occur sequentially or simultaneously. In the latter case, the expander can be continuously in contact with the inner surface of the tubular element whereby the body segments return to their undeformed configuration during forward movement of the expander. Suitably the restoring force for the body segments to return to their undeformed configuration results from such continuous contact of the body segments with the inner surface of the tubular element. Forward movement of the expander is stopped upon the expander reaching its retracted mode.

We claim:

1. An expander system for radially expanding a tubular element having an unexpanded portion of a first inner diameter, the expander system including an expander movable between a radially retracted mode and a radially expanded mode, the expander being operable to expand the tubular element from said first inner diameter to a second inner diameter larger than the first inner diameter by movement of the expander from the radially retracted mode to the radially expanded mode thereof, wherein the expander includes a contact section, said contact section having an expanded mode and a retracted mode, wherein of the diameter of said contact section in said retracted mode is larger than said first inner diameter, and wherein said contact section is arranged to prevent axial movement of the expander through the unexpanded portion of die tubular element when the expander is in the radially retracted mode, and wherein the expander includes an expansion surface extending in axial direction and being operable to move radially outward so as to expand the tubular element during movement of the expander from the retracted mode to the expanded mode thereof, said expansion surface being of varying diameter in axial direction.

2. The expander system of claim 1, wherein said contact section of the expander has an outer surface coinciding with the expansion surface.

3. The expander system of claim 1, wherein the diameter of the expansion surface increases continuously in axial direction.

4. The expander system of claim 1, wherein said expansion surface is arranged to move radially outward in substantially uniform manner along the length thereof during movement of the expander from the retracted mode to the expanded mode thereof.

5. The expander system of claim 1, wherein the tubular element extends into a borehole formed in an earth formation.

6. The expander system of claim 1, wherein said expansion surface is a tapering surface.

7. The expander system of claim 6, wherein said expansion surface has a frustoconical shape.

8. The expander system of claim 1, wherein the expander comprises an expander body including a plurality of body segments spaced along the circumference of the expander body, each segment extending in longitudinal direction of the expander and being movable between a radially retracted position and a radially expanded position.

9. The expander system of claim 8, wherein the expander body is provided with a plurality of longitudinal slots spaced along the circumference of the expander body, each said slot extending between a pair of adjacent body segments.

10. The expander system of claim 8, wherein each body segment is at both ends thereof integrally formed with the expander body.

11. An expander system for radially expanding a tubular element having an unexpanded portion of a first inner diameter, the expander system including an expander movable between a radially retracted mode and a radially expanded mode, the expander being operable to expand the tubular element from said first inner diameter to a second inner diameter larger than the first inner diameter by movement of the expander from the radially retracted mode to the radially expanded mode thereof, wherein the expander comprises a contact section, and wherein said contact section is arranged to prevent axial movement of the expander through the unexpanded portion of the tubular element when the expander is in the radially retracted mode, wherein the expander is arranged in the tubular element, the expander being in the radially retracted mode thereof, and wherein said contact section is in contact with the inner surface of the tubular element so as to prevent axial movement of the expander through the unexpanded portion of the tubular element;

wherein said contact section of the expander has a smallest diameter smaller than said first inner diameter, and a largest diameter larger than said first inner diameter when the expander is in the radially retracted mode.

12. An expander system for radially expanding a tubular element having an unexpanded portion of a first inner diameter, the expander system including an expander movable between a radially retracted mode and a radially expanded mode, the expander being operable to expand the tubular element from said first inner diameter to a second inner diameter larger than the first inner diameter by movement of the expander from the radially retracted mode to the radially expanded mode thereof, wherein the expander comprises a contact section of a diameter larger than said first inner diameter when the expander is in the radially retracted mode, and wherein said contact section is arranged to prevent axial movement of the expander through the unexpanded portion of the tubular element when the expander is in the radially retracted mode; wherein the expander is arranged in the tubular element, the expander being in the radially retracted mode thereof, and wherein said contact section is in contact with the inner surface of the tubular element so as to prevent axial movement of the expander through the unexpanded portion of the tubular element; wherein the expander comprises an expander body including a plurality of body segments spaced along the circumference of the expander body, each segment extending in longitudinal direction of the expander and being movable between a radially retracted position and a radially expanded position; and wherein the expander body is a tubular expander body, and wherein the expander includes an inflatable fluid chamber arranged within the tubular expander body so as to move each body segment radially outward upon inflation of the fluid chamber.

13. The expander system of claim 12, wherein said fluid chamber is formed within an inflatable bladder arranged within the tubular body.

14. The expander system of claim 12, further including a fluid flow control system for controlling inflow of fluid into the fluid chamber and/or outflow of fluid from the fluid chamber.

15. The expander system of claim 14, wherein the fluid flow control system is arranged to control said fluid inflow and said fluid outflow in alternating mode.

16. The expander system of claim 14, wherein the fluid control system includes a valve for controlling outflow of fluid from the inflatable fluid chamber.

17. The expander system of claim 16, wherein the valve is provided with electric control means arranged to control the valve.

18. The expander system of claim 17, wherein the electric control means comprises an electric conductor extending through a conduit for the transfer of fluid to or from the inflatable fluid chamber.

19. A method of radially expanding a tubular element using the expander system for radially expanding a tubular element having an unexpanded portion of a first inner diameter, the expander system including an expander movable between a radially retracted mode and a radially expanded mode, the expander being operable to expand the tubular element from said first inner diameter to a second inner diameter larger than the first inner diameter by movement of the expander from the radially retracted mode to the radially expanded mode thereof, wherein the expander comprises a contact section of a diameter larger than said first inner diameter when the expander is in the radially retracted mode, and wherein said contact section is arranged to prevent axial movement of the expander through the unexpanded portion of the tubular element when the expander is in the radially retracted mode, wherein the expander is arranged in the tubular element, the expander being in the radially retracted mode thereof, and wherein said contact section is in contact with the inner surface of the tubular element so as to prevent axial movement of the expander through the unexpanded portion of the tubular element, comprising the steps of:

a) arranging the expander within the tubular element;

b) moving the expander from the retracted mode to the expanded mode thereof so as to expand the tubular element;

c) moving the expander from the expanded mode to the retracted mode thereof;

d) allowing the expander to move axially through the tubular element by the action of an axial force exerted to the expander, until further movement is prevented by virtue of the expander being in the retracted mode and said contact section contacting the inner surface of the tubular element; and e) repeating steps b)-d) until the expander has expanded the tubular element or a desired portion thereof, from the first diameter to the second diameter.

* * * * *